United States Patent [19]

Yoshida

[11] 4,328,918

[45] May 11, 1982

[54] STOP FIXING DEVICE FOR SLIDE FASTENER

[75] Inventor: Hiroshi Yoshida, Kurobe, Japan

[73] Assignee: Yoshida Kogyo K.K., Tokyo, Japan

[21] Appl. No.: 96,568

[22] Filed: Nov. 21, 1979

[30] Foreign Application Priority Data

| | | | |
|---|---|---|---|
| Nov. 25, 1978 | [JP] | Japan | 53-145608 |
| Nov. 25, 1978 | [JP] | Japan | 53-145609 |
| Nov. 25, 1978 | [JP] | Japan | 53-162217[U] |

[51] Int. Cl.[3] ..... B25C 5/04

[52] U.S. Cl. ..... 227/83; 227/120; 227/144

[58] Field of Search ..... 29/432.1; 227/83, 120, 227/142, 144, 143, 147, 156, 121, DIG. 1

[56] References Cited

U.S. PATENT DOCUMENTS

| | | | |
|---|---|---|---|
| 2,153,874 | 4/1939 | Posnack | 29/432.1 |
| 2,185,518 | 1/1940 | Posnack | 29/432.1 |
| 2,589,491 | 3/1952 | Goodstein | 29/432.1 |
| 2,931,038 | 4/1960 | Wandel | 227/83 |
| 3,314,581 | 4/1967 | Kapitanov et al. | 227/142 |
| 3,757,629 | 9/1973 | Schneider | 227/83 X |

FOREIGN PATENT DOCUMENTS

| | | | |
|---|---|---|---|
| 641073 | 1/1937 | Fed. Rep. of Germany | 227/120 |
| 664437 | 9/1938 | Fed. Rep. of Germany | 227/144 |
| 154747 | 10/1938 | Fed. Rep. of Germany | 227/144 |

*Primary Examiner*—Paul A. Bell

*Attorney, Agent, or Firm*—Hill, Van Santen, Steadman, Chiara & Simpson

[57] ABSTRACT

A stop fixing device for a slide fastener according to this invention generally comprises upper and lower levers, an elongated guide member defining a channel therein for slidably receiving a band of stops, a pivot for connecting the levers and the guide member for relative rotation and a punch mechanism including a punch guide channel communicated with the forward end of the channel in the guide member and a punch received in the punch guide channel. The punch guide channel has a width substantially equal to the distance between the shoulders of the stop and has a widened portion where it communicates with the channel of the guide member. Cam surfaces are provided at the lower end of the opposite side walls of the widened portion. A stop arrester is provided at the forward end of the guide member for preventing movement of the stop band in a vertical direction. A regulator plate is adjustably mounted on one of the levers to engage the other lever for controlling spread angle of the levers.

3 Claims, 16 Drawing Figures

Fig. 9
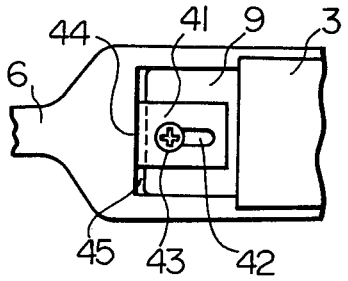
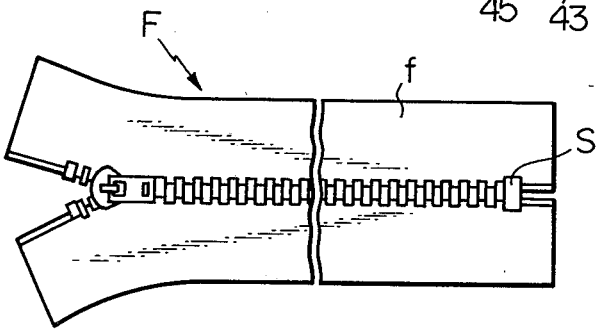
Fig. 10
Fig. 11A
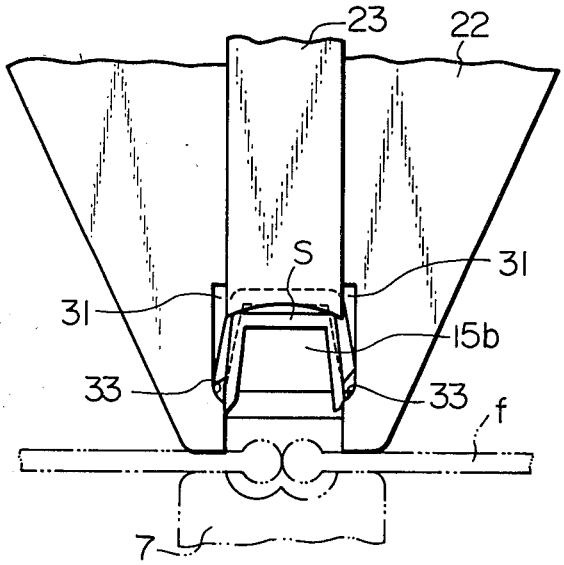

PRIOR ART

STOP FIXING DEVICE FOR SLIDE FASTENER

BACKGROUND OF THE INVENTION

This invention relates to a manually operable stop fixing device which secures a stop, such as top end and bottom end stops, to the tapes of a slide fastener. More specifically, the invention relates to an improved stop fixing device in which the operation for securing a stop to the tapes of a slide fastener is very reliable.

Upon attaching to clothes, a complete slide fastener is usually sewn as a whole onto the clothes. However, somtimes it is desired to employ a process including the steps of cutting a piece of a desired length from a continuous long fastener chain, sewing the piece to clothes and then mounting on the piece a top end stop and/or a bottom end stop and a slider to complete a slide fastener. For use in such process, a manually operable stop fixing device for slide fasteners has been well known. Such device operates in the same manner as that of a conventional device for stapling paper sheets, in which by squeezing upper and lower levers a driver descends to press down a stop, causing a die portion to bend the legs of the stop.

In the stop fixing device of this kind, a stop band consisting of a plurality of stops stuck together is loaded in an elongated guide member. By driving the leading end of the stop band, the stops are successively driven to penetrate tapes of fastener stringers and are secured thereto.

One of the stop fixing devices of this kind is disclosed in German Utility Model No. 1902794.

The stop fixing device of this kind is compact and easy to carry. Therefore, it has been advantageously used in securing stops such as bottom end stops of slide fasteners.

However, there are still some problems in connection with the stop fixing devices of this kind. Firstly, there will be no trouble if an operator presses the driver through its full stroke to completely push down the stop. However, if a user presses the driver only midway of the full stroke and then releases the levers, the stop sticks in a guide channel without being completely pushed down. If the user squeezes the levers again to press the driver for pushing down the next stop, the ends of the legs of the next stop enter the clearance between the shoulders of the former stop and the guide channel walls, thereby causing a jam. This clearance exists because the width of the guide channel is made larger than the distance between the shoulders of the stop to compensate for varitation in the shape of the stops and assembling tolerance of the stop fixing device. As a result, it is impossible to push out the succeeding stops without partially disassembling the device to remove the stuck stops therefrom.

Furthermore, since the width of the guide channel is greater than the distance between the shoulders of the stop, it is seldom that the legs of the stop are positioned normal to the plane of the tapes. Therefore, the tapes are not accurately punctured and securement of the stop is not reliable.

Secondly, upon forming a stop blank into a bottom-side-opened rectangle, the distance between the outer surfaces of the two legs of the stop varies from piece to piece. Furthermore, most stops are formed into a trapezoid in which the legs thereof diverge. Therefore, an elongated guide member, in which a stop band consisting of a plurality of stops stuck together is received, must be so formed that a certain clearance is provided between the stop band and the guide walls of the guide member for compensating for variation in shape of the stops. A plunger or follower, which is provided for sliding movement along the guide walls of the elongated guide member to forwardly urge the stop band, is also formed into a bottom-side-opened rectangle, the plate composing the follower being thicker than that of the stop. Therefore, the stop band is received in the elongated guide member with certain clearances from the opposite side walls and the upper wall.

The stop at the leading end of the stop band forwardly urged in the guide member is received in a driver guide channel, with the bottom end of the stop unsupported. Therefore, if this stop is driven, a moment is applied to the stop band about the forward edge of the guide member. Because of the existence of the abovementioned clearance, the band rotates, thereby angularly moving the leading stop from its vertical position. This causes the stop to bear against the inner wall of the driver guide channel or the lower portion of the end of the guide member. This makes the driver relatively hard to operate and also makes fixing of the stop unreliable.

Thirdly, size of user's hands of a stop fixing device varies from person to person. Therefore, unless the width of the grip defined by two levers is optimum to a user, there is possibility of misoperation.

SUMMARY OF THE INVENTION

Therefore, an object of the invention is to solve the abovementioned problems and to provide a stop fixing device reliable in operation.

According to one aspect of the invention, a guide channel for guiding a driver is so formed that the width thereof is substantially equal to the distance between the shoulders of a stop. At a portion of the guide channel communicating with the forward end of an elongated guide member for receiving a stop band, the opposite side walls are recesses so as to form a guide channel portion wider than the distance between the shoulders of the stop. Curved or inclined cam surfaces are provided at the lower end of the guide channel portion.

According to another aspect of the invention, a stop arrester is provided in the leading end portion of the elongated guide member. Said arrester holds the upper surface of the stop band and prevents its vertical movement. Due to this arresting effect, the stop band is prevented from rotation about the forward edge of the guide member. Therefore, the stops are pushed out accurately in the vertical direction and surely fixed to the tapes of fastener stringers.

According to another aspect of the invention, a regulator plate is mounted on one of upper and lower levers so as to restrict spread angle of the levers by engaging the other lever. The regulator plate is adjustable relative to the lever to which it is connected.

BRIEF DESCRIPTION OF THE DRAWINGS

These and other objects and features of the invention will be apparent from the following description of embodiments of the invention referring to the accompanying drawings, in which:

FIG. 9 is a view of a portion of the device in FIG. 8 seen from the bottom;

FIG. 10 is a plan view of a slide fastener to which a stop is fixed;

FIGS. 11A to 11C are schematic views corresponding to FIG. 7 successively showing the driving operation in the device of this invention;

DETAILED DESCRIPTION OF THE PREFERRED EMBODIMENTS

Figure 1:
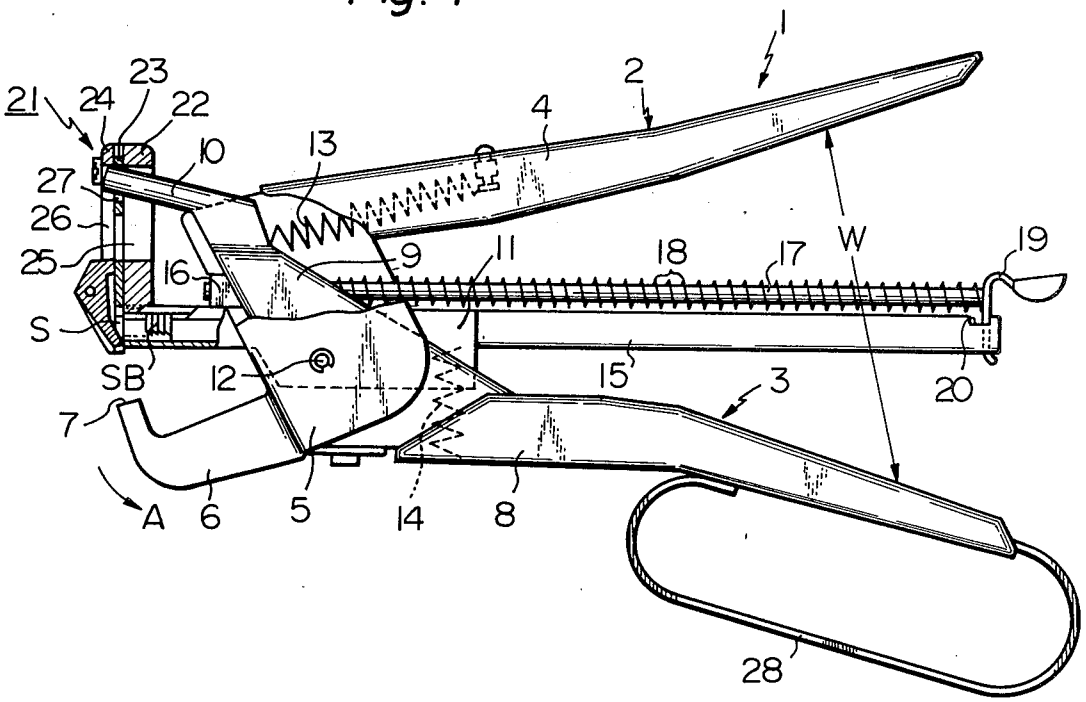
FIG. 1 is a side elevational view of a stop fixing device according to this invention showing the general construction thereof.
Figure 2:
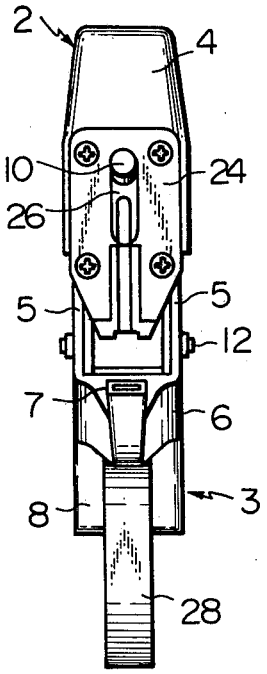
FIG. 2 is a front elevational view of the device shown in FIG. 1.

Referring to FIG. 1, there is shown a stop fixing device 1 for sliding fasteners according to this invention, which includes a pair of upper and lower levers 2 and 3. The upper lever 2 comprises a main lever portion 4, support plates 5 disposed in parallel and connected to the forward end of the main lever portion 4 with a predetermined distance therebetween and a die portion 6 connected to the forward ends of the support plates 5. The forward end of the die portion 6 is upwardly bent to form an anvil 7.

The lower lever 3 comprises a main lever portion 8, a support block 9 disposed between the support plates 5 and connected to the forward end of the main lever portion 8 and a cylindrical actuator 10 connected to the forward end of the support block 9. The support block 9 is formed with a through hole in which another block 11 is inserted. Numeral 12 indicates a pivot which rotatably combines the support plates 5, the support block 9 and the block 11. A tension spring 13 is situated between the upper main lever portion 4 and the upper portion of the support block 9 for angularly biasing the upper lever 2 in the direction indicated by A in FIG. 1. A compression spring 14 is situated between the lower portion of the support block 9 and block 11 for keeping the space between the support block 9 and the block 11 and therefore the space between the lower main lever portion 8 and the block 11 constant.

Figure 3:
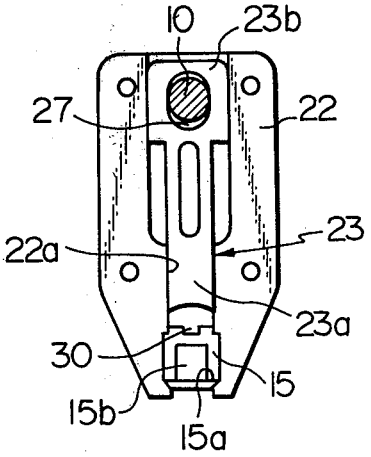
FIG. 3 is a front elevational view of the driving mechanism of the device in which the cover thereof is removed for making clear the mechanism.
Figure 5:
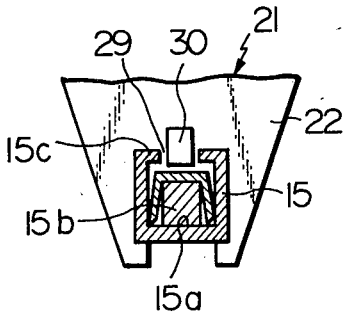
FIG. 5 is a transverse sectional view taken along the line V—V in FIG. 4.

Numeral 15 designates a channel shaped elongated guide member secured to the block 11 and having a rail 15*b* formed in a channel 15*a* (see FIGS. 3 and 5). A stop band SB, which consists of a plurality of stops S each having the shape of a bottom-side-opened rectangle separably stuck together, is loaded in the guide member in which it straddles the rail 15*b* for sliding movement therealong. A follower 16 is so formed that it is also slidably received in the guide member 15. In a through hole of the follower 16, a spring guide rod 17 is slidably received, around which a compression spring 18 is mounted. A stopper 19 is fixed to the rear end of the rod 17. A portion of the stopper is adapted to be received in a slot 20 provided in the rear end of the guide member 15. When received in the slot 20, the stopper 19 compresses the compression spring 18 to urge the follower 16, thereby forwardly biasing the stop band SB placed in front of the follower 16.

A driving mechanism 21 is vertically provided at the forward end of the elongated guide member 15. The driving mechanism 21 comprises a driver guide 22 connected to the forward end of the elongated guide member 15 and having a driver guide channel 22*a*, a punch 23 slidably received in the guide channel 22*a* and a cover 24 secured to the driver guide 22 for preventing removal of the driver or punch 23. As shown in FIG. 3, the forward end surface of the elongated guide member 15 is exposed to the guide channel 22*a* and placed flush with the bottom surface of the channel 22*a*. Depth of the guide channel 22*a* is so selected that only one stop S at the leading end of the stop band SB urged by the follower 16 is received in the guide channel 22*a* and is separated from the other stops when depressed by the descending driver 23. The driver guide 22 and the cover 24 have elongated slots 25 and 26, respectively, and the driver 23 has an opening 27. The forward end of the cylindrical actuator 10 passes through the elongated slots 25 and 26 and the opening 27 so that the punch 23 vertically moves according to the vertical movement of the actuator 10 in the slots 25 and 26. When the driver descends, the stop S, which is at the forward end of the stop band SB extending from the guide member 15 into the guide channel 22*a* beneath the driver 23, is depressed by the bottom surface of the driver 23. Therefore, the stop is separated from the band SB and pushed out from the downwardly open guide channel 22*a*. The tips of both legs of the stop S are angularly formed so that they can penetrate the tapes (f) of slide fastener F. The stop driver out from the guide channel 22*a* is pressed against the anvil 7 of the die portion 6. The anvil 7 is formed with round recesses at the places corresponding to the two legs of the stop S so that as the stop S is pressed downwardly, both the legs are bent inwardly towards each other to secure the stop to the tapes.

Numeral 28 designates a hand ring provided at the rear end of the lower lever 3 for keeping the fingers of user in place.

The upper wall 15*c* of the elongated guide member 15 has a longitudinally extending opening 29. A portion of the follower 16 extends through the opening 29 so that the biasing force can be imparted to the follower 16 from the spring 18 placed outside the guide member.

Figure 4:
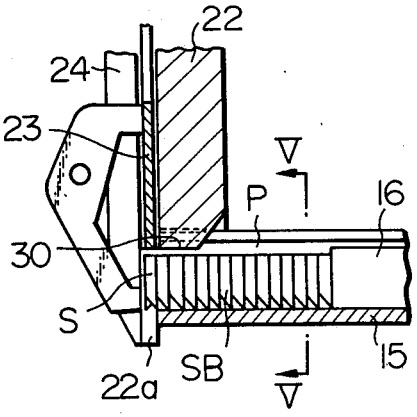
FIG. 4 is a longitudinal sectional view of the forward end portion of the device.

According to this invention, a stop arrester 30 depends from the bottom of the punch guide 22 so that is extends through the opening 29 into the channel 15*a* at the forward end portion of the guide member 15 to hold the stop band SB straddling the rail 15*b* (see FIGS. 4 and 5).

Figure 6:
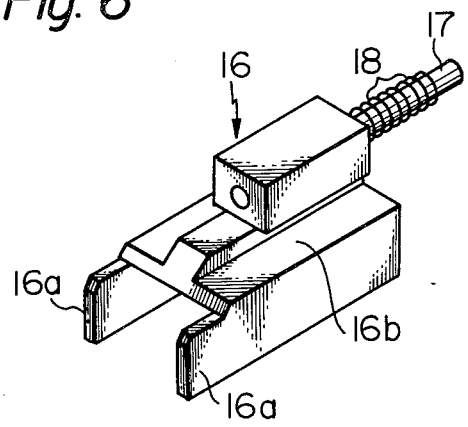
FIG. 6 is a perspective view of a follower used in the device according to the invention.

The follower 16 comprises right and left side walls 16*a* and a top wall 16*b* forming altogether a bottom-side-opened rectangle so that is can slide in the channel 15*a* of the guide member 15. At the forward end, the upper wall 16*b* is recessed so that it does not interfere with the stop arrester 30 depending into the channel 15*a* (see FIG. 6). Therefore, the forward ends of the right and left side walls 16*a* can reach the bottom of the guide channel 22*a* (the surface of the driver guide 22 defining the right side of the guide channel 22*a* as viewed in FIGS. 1 and 4). Thus, having the forward end of the upper wall 16*b* recessed, the stops S can, to the last one, reach the guide channel 22*a* pushed by the side walls 16*a* irrespective of the presence of the arrester 30.

According to another feature of the invention, the driver 23 is generally formed into a T like shape comprising a main driver portion 23*a* and a base portion 23*b* provided with the opening 27. The guide channel 22*a* is also formed into a T like shape so as to accomodate the generally T shaped driver 23. The main driver portion 23*a* is so formed that the width thereof is substantially equal to the distance SW between the shoulders of the stop S. Furthermore, the guide channel 22*a* accomodating the main driver portion 23*a* is also so formed that the width thereof is substantially equal to the distance SW between the shoulders of the stop S so as to slidably receive the main driver portion 23*a*. Numeral 31 designates a widened guide channel portion which has a width substantially equal to the distance RW between the outer surfaces of the ends of the opposite legs of the stop S so that it can receive one stop S at the leading end of the stop band SB forwardly biased in the elongated guide member 15. The widened guide channel portion has a height substantially equal to that of the stop S. Numeral 32 designates recessed surfaces defining the opposite sides of the widened guide channel portion 31. Cam surfaces 33 are provided at the lower ends of the recessed surfaces 32. While the cam surfaces 33 illustrated in the drawings are round, straight slant cam surfaces can also be used.

Figure 8:
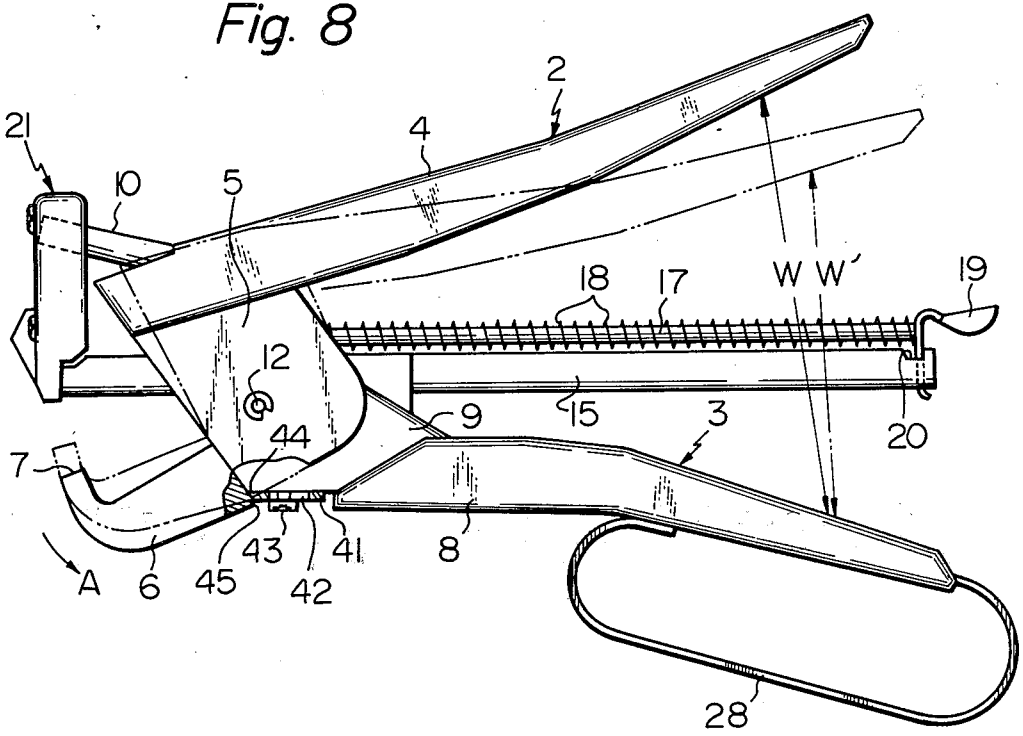
FIG. 8 is a side elevational view of the same device shown in FIG. 1 in which means for controlling the spread angle of the levers is made clear.

As is specifically shown in FIGS. 8 and 9, the stop fixing device of this invention has a regulator plate 41 which is mounted on the lower surface of the support block 9 of the lower lever 3 by a screw 43. The regulator plate is formed with an elongated slot 42 through which the screw 43 extends, whereby the regulator plate is mounted adjustably in the forward and rear direction. The forward end of the regulator plate 41 defines a bearing surface 44 and the rear end of the base of the die portion 6 defines a stopper surface 45. The upper lever 2 is biassed by the tension spring 13 (FIG. 1) in the rotational direction A shown in FIGS. 1 and 8 about the pivot 12. The rotation of the lever 2 in the direction A is stopped when the stopper surface 45 engages the bearing surface 44 of the regulator plate 41. By forwardly shifting the regulator plate 41 the stopper surface 45 comes to contact the bearing surface 44 of the regulator plate 41 after traveling a shorter rotational distance as shown by the phantom lin in FIG. 8. Thus, the extent of swing of the upper lever 2 is limited to a narrower range. Therefore, a spread angle or a grip width W defined by the upper and lower levers 2 and 3 is made small as shown by W'. On the other hand, by rearwardly shifting the regulator plate 41, the stopper surface 45 comes to contact the bearing surface 44 of the regulator plate 41 after traveling a longer distance, thereby increasing the range of swing of the upper lever 2. Therefore, the grip width W defined by the levers 2 and 3 increases. Thus, the grip width W can be easily adjusted by shifting the regulator plate 41 in the forward and rear direction.

The operation of the stop fixing device of the above-mentioned construction will be explained.

Figure 7:
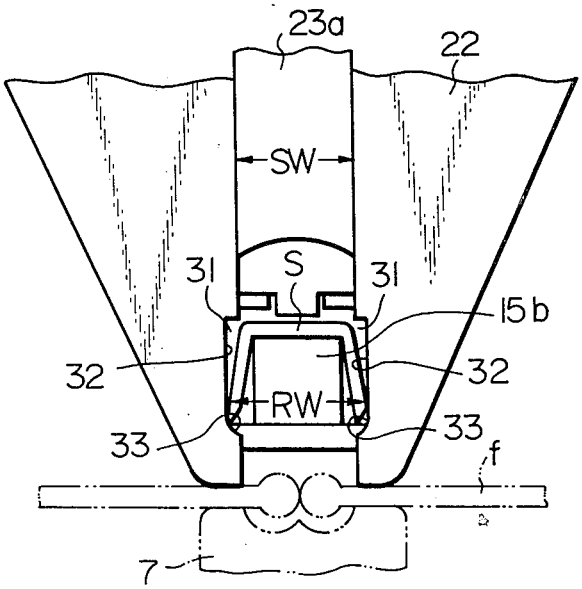
FIG. 7 is an enlarged front elevation of the driving mechanism shown in FIG. 3 showing the portion around the widened punch guide channel portion.

When a user squeezes the levers 2 and 3 after he loaded a stop band SB in the guide member 15, the upper main lever portion 4 first descends against the effect of the spring 13 and the die portion 6 concomitantly moves upward until the anvil 7 at the forward end thereof engages the bottom of the driving mechanism 21. When the user increases the squeezing force imparted to the levers 2 and 3, the lower main lever portion 8 moves up against the effect of the compression spring 14 and the cylindrical actuator 10 concomitantly descends in the elongated slots 25 and 26. When this occurs, the driver 23 descends in the guide channel 22*a* of the driver guide 22 and presses the stop S at the leading end of the stop band SB against the anvil 7 where the stop is deformed so that both the legs thereof are inwardly bent. Upon releasing the levers 2 and 3 after the deformation of the stop, the lower main lever portion 8 first swings downwardly urged by the compression spring 14 causing concomitant upward movement of the cylindrical actuator 10 and the driver 23. Then the upper main lever portion 4 swings upward by the effect of the tension spring 13 causing the die portion 6 to descend. In this position, the levers 2 and 3 have returned to their original states. When it is desired to fix the stop S to the tapes (f) of the fastener chain, the portions of the tapes where the stop is to be fixed are first placed on the anvil 7 as shown in FIG. 7 and then the levers 2 and 3 are squeezed. After fixing of the stop, the levers 2 and 3 are released. Thus, the slide fastener F is completed as shown in FIG. 10 wherein bottom stop means is provided by fixing the stop S to the tapes (f) of the fastener chain.

Figure 11B:
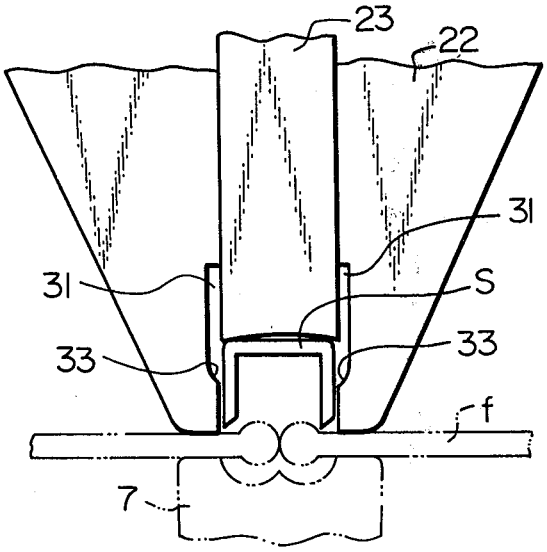
Figure 11C:
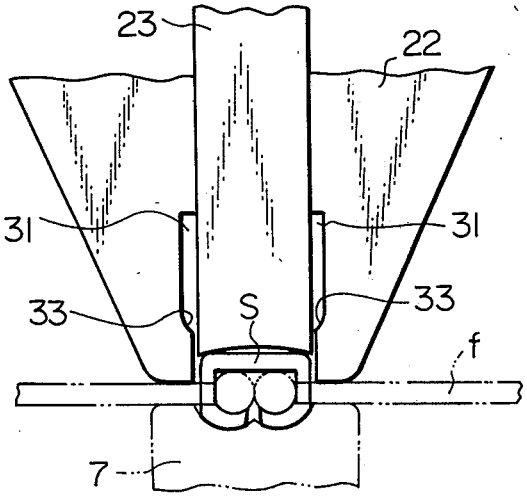

In the present invention, when the driver 23 is pushed down with the leading stop S is the widened guide channel portion 31, the lower portions of the legs of the stop S are guided along the cam surfaces 33 at the lower portion of the widened guide channel portion 31 (see FIG. 11A) until the original width thereof RW decreases to the distance SW between the shoulders. Then the stop is led to the lower portion of the guide channel 22*a* (FIG. 11B) and is thereafter deformed as shown in FIG. 11C. Thus, both legs of the stop S are driven into the tapes (f) of the slide fastener chain normally to the plane of the tapes. Therefore, reliable securement of the stop is obtained.

Figure 12:
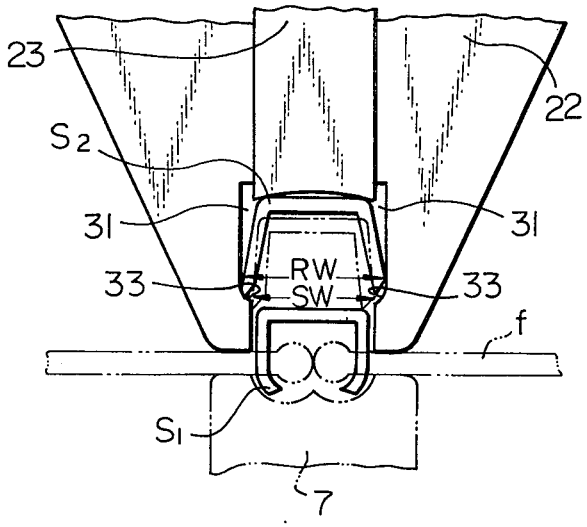
FIG. 12 is a schematic view of the driving mechanism of the device wherein a former stop remains in the driver guide channel when a subsequent stop is driven.

As is shown in FIG. 12, even if a succeeding stop S2 is driven down while a leading stop S1 remains in the lower portion of the guide channel 22*a*, it does not happen that the ends of the legs of the succeeding stop are driven between the leading stop and the walls of the guide channel 22*a*, since there is substantially no clearance between the stop S1 and the opposite side surfaces of the guide channel 22*a*. As is shown by the phantom line in FIG. 12, the distance RW between the outer surfaces of the legs of the stop S2 is smoothly reduced to the distance SW between the shoulders by the effect of the cam surfaces 33. Therefore, the leg ends of the stop S2 come to contact the upper surface of the shoulders of the stop S1. Therefore, the stop S2 can, without changing the relative position to stop S1, depress the stop S1 to fix the same to the tapes. Therefore, jamming in the guide channel is effectively prevented. Furthermore, even if a single stop separates from the body of the stop band SB and rests in the widened guide channel portion, the stop does not fall out, since there is a narrow lower portion of the guide channel 22*a* beneath the stop.

Figure 14:
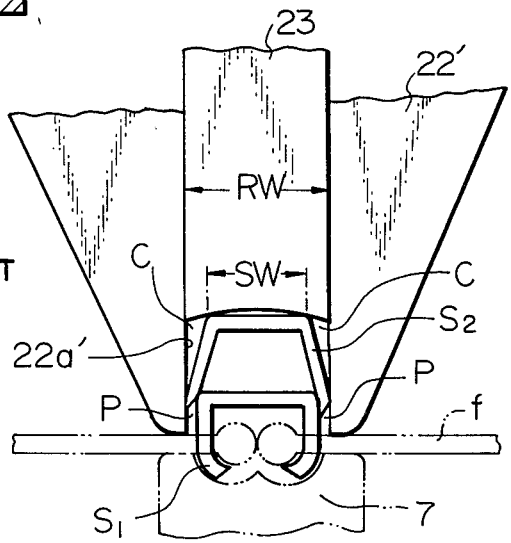
Fig. 14 PRIOR ART

For comparison with the present invention, FIG. 14 shows a portion of a conventional stop fixing device. In this device, the guide channel 22*a'* is wider than the distance SW between the shoulders of the stop S and substantially equal to the distance RW between the outer surfaces of the leg ends of the same. Therefore, when the stop S is placed in the guide channel 22*a'*, there are certain spaces C between the shoulders of the stop S and the opposite side surfaces of the guide channel 22*a'*. These spaces do not cause any trouble if the stop S is completely pushed out from the device in every driving operation. However, if the driver is somehow stopped half-way of its full stroke and if a subsequent stop S2 is driven while the leading stop S1 is in the guide channel 22*a'* as shown in FIG. 14, the legs of the subsequent stop S2 enter the spaces C between the leading stop S1 and the opposite side surfaces of the guide channel 22*a'* and stick there. Thus, it occasionally happens that the fixing operation can not be continued without disassembling the cover 24 from the device to remove the stuck stops S1 and S2.

Furthermore, since the guide channel 22*a'* is wider than the distance between the shoulders of the stop S, it is seldom that the legs of the stop penetrate normally to the plane of the tapes when the stop is driven from the device. This makes the stop fixing device relatively hard to operate and there is possibility of malfunction in bending or deforming the stop legs. Furthermore, if a separate stop is introduced in the guide channel, the stop descends in the guide channel 22*a'* without being driven and falls out of the guide channel.

In the stop fixing device 1 of this invention, the stop arrester 30 is provided at the forward end of the guide member 15 and depends into the space P between the upper surface of the stop band SB and the upper wall 15*c* of the guide member 15 to hold the stop band SB against its upward movement. Therefore, when the stop at the leading end of the stop band SB is driven, it is straightly pressed down in the vertical direction and driven into the tape normally to the plane thereof. Furthermore, it does not impinge on or bear against the walls surrounding it. Therefore, the driver can be operated lightly and crisply.

Figure 13:
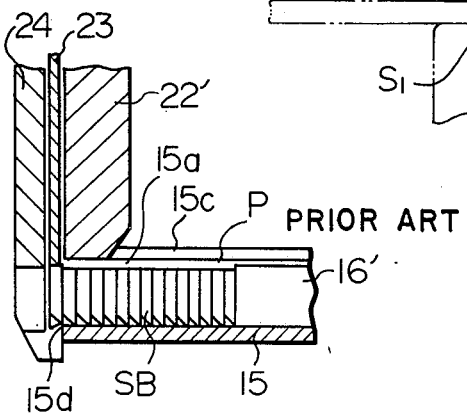
FIGS. 13 and 14 are partial illustrations of a conventional stop fixing device corresponding to FIGS. 4 and 12, respectively, presented for making clear the advantages of this invention.

A conventional stop fixing device is shown for the purpose of comparison in FIG. 13, in which elements having shapes different from those of the corresponding elements in the embodiments of the invention have primes for distinction. In this device, there is also a space P between the upper wall 15*c* of the guide member 15 and the upper surface of the stop band SB loaded in the channel 15*a* of the guide member 15. However, there is no means for arresting the movement of the stop band SB. Thus, when the stop S at the leading end of the stop band SB is driven, a moment is created about the forward edge 15*d* of the guide member channel 15*a* to rotate the stop band SB. Therefore, the stop can not be pressed accurately in the vertical direction. Rather, it tends to rotate in the counterclockwise direction as seen in FIG. 13. This results in the stop bearing against the bottom surface of the driver guide channel 22*a* and/or the lower portion of the forward end of the guide member 15, thereby making the driver relatively hard to operate and making securement of the stop unsure. It is necessary that the forward end of the upper wall of a plunger 16' be recessed.

If a user wants to change the grip width of the stop fixing device, he may loosen the screw 43 to shift the regulator plate 41 and then fasten the screw to fix the regulator plate 41 at the place where it gives an optimum grip width.

While the regulator plate 41 is fixed to the under surface of the support block 9 in the illustrated arrangement, this invention is not limited to this particular arrangement. The essential matter is that the spread angle of the levers is controlled. Therefore, it is accepted to mount the regulator plate on the forward end of the upper main lever portion 4 and to make the surface of the base portion of the cylindrical actuator act as a stopper surface.

What is claimed is:

1. A stop fixing device for a slide fastener comprising:

an upper lever having a die portion at the forward end thereof;

a lower lever having an actuator at the forward end thereof;

an elongated guide member defining an elongated channel therein for slidably receiving a band of stops;

a pivot for connecting said levers and the guide member for rotation relative to each other with the guide member between the two levers;

spring means angularly biasing the two levers from the guide member;

a follower received in the guide member for forwardly urging the stop band loaded therein;

a driving mechanism having a driver guide channel communicating with the forward end of said elongated channel in the guide member so as to receive the leading stop of the stop band and a driver being engaged by said actuator and being received in said driver guide channel for movement therein when actuated by said actuator, the device being so arranged that upon squeezing the levers together, the leading stop of the stop band is compressed between said driver and said die portion of the upper lever, the improvements comprising:

means for controlling the opening spread angle of said levers including a regulator plate, means for adjustably mounting said plate on one of said two levers and a stopper surface on the other lever being engaged by said plate for controlling the opening spread angle of the levers.

2. A stop fixing device according to claim 1, further characterized in that said driver guide channel is defined by a groove formed in a driver guide fixed to the forward end of the elongated guide member; said guide member has an upper wall provided with a longitudinally elongated opening through which a portion of the follower extends so that a spring placed outside the guide member imparts biasing force to the follower; and a stop arrester depends from the bottom of said driver guide through said elongated opening into said elongated channel of the guide member for preventing rotation of the stop band due to the moment caused by depression of the driver.

3. A stop fixing device according to claim 2, further characterized in that said follower is formed into a bottom-side-opened rectangle including an upper wall and opposite sidewalls and the forward end portion of the upper wall is recessed for preventing interference with said stop arrester.

* * * * *